US011643894B2

(12) United States Patent
Moen et al.

(10) Patent No.: US 11,643,894 B2
(45) Date of Patent: May 9, 2023

(54) METHODS AND SYSTEMS FOR MAPPING A WELLBORE FOR REFRACTURING

(71) Applicant: COMITT WELL SOLUTIONS US HOLDING INC., Katy, TX (US)

(72) Inventors: Eivind Moen, Houston, TX (US); Roger Antonsen, Houston, TX (US)

(73) Assignee: Comitt Well Solutions LLC, Katy, TX (US)

( * ) Notice: Subject to any disclaimer, the term of this patent is extended or adjusted under 35 U.S.C. 154(b) by 245 days.

(21) Appl. No.: 17/199,684

(22) Filed: Mar. 12, 2021

(65) Prior Publication Data

US 2021/0293106 A1 Sep. 23, 2021

Related U.S. Application Data

(60) Provisional application No. 62/991,260, filed on Mar. 18, 2020.

(51) Int. Cl.

| | |
|---|---|
| ***E21B 23/06*** | (2006.01) |
| ***E21B 33/124*** | (2006.01) |
| ***E21B 43/26*** | (2006.01) |
| ***E21B 33/128*** | (2006.01) |
| ***E21B 49/00*** | (2006.01) |
| *E21B 47/06* | (2012.01) |

(52) U.S. Cl.

CPC ..... *E21B 23/06* (2013.01); *E21B 33/124* (2013.01); *E21B 33/1285* (2013.01); *E21B 43/26* (2013.01); *E21B 49/008* (2013.01); *E21B 47/06* (2013.01)

(58) Field of Classification Search

CPC .... E21B 23/06; E21B 33/124; E21B 33/1285; E21B 43/26; E21B 49/008; E21B 47/06

See application file for complete search history.

(56) References Cited

U.S. PATENT DOCUMENTS

| | | | | |
|---|---|---|---|---|
| 5,337,821 | A * | 8/1994 | Peterson | E21B 47/10 175/48 |
| 2016/0084056 | A1* | 3/2016 | Flores | E21B 23/06 166/250.01 |
| 2016/0123126 | A1* | 5/2016 | Portman | E21B 43/26 166/250.01 |
| 2018/0163510 | A1* | 6/2018 | Cleven | E21B 37/08 |
| 2018/0363460 | A1* | 12/2018 | Fitzel | E21B 47/10 |
| 2019/0186229 | A1* | 6/2019 | Hrupp | E21B 43/26 |

* cited by examiner

*Primary Examiner* — Christopher J Sebesta
(74) *Attorney, Agent, or Firm* — Pierson IP, PLLC

(57) ABSTRACT

Examples of the present disclosure relate to systems and methods for mapping a wellbore for refracturing. More specifically, embodiments are directed towards utilizing downhole pressure data to identify previously untreated clusters, clusters with cross contamination, and clusters with proper zonal isolation with full pressure integrity.

6 Claims, 7 Drawing Sheets

| | Stage #4 | | | | Stage #3 | | | | Stage #2 | | | | Stage #1 | | | |
|---|---|---|---|---|---|---|---|---|---|---|---|---|---|---|---|---|
| Cluster #: | 16 | 15 | 14 | 13 | 12 | 11 | 10 | 9 | 8 | 7 | 6 | 5 | 4 | 3 | 2 | 1 |
| Breakdown Pressure | 7539 | 4769 | 7011 | 4513 | 5575 | 5342 | 5614 | 6859 | 7789 | 4917 | 5263 | 5844 | 6126 | 3914 | 4282 | 4624 |
| Cross Communication? | NO | NO | NO | NO | NO | NO | NO | NO | NO | NO | NO | NO | NO | YES | YES | NO |
| Recommended treatment: | FRAC | ACID | FRAC | ACID | FRAC | FRAC | FRAC | FRAC | FRAC | ACID | FRAC | FRAC | FRAC | ACID | ACID | ACID |

METHODS AND SYSTEMS FOR MAPPING A WELLBORE FOR REFRACTURING

BACKGROUND INFORMATION

Field of the Disclosure

Examples of the present disclosure relate to systems and methods for mapping a wellbore for refracturing. More specifically, embodiments are directed towards utilizing downhole pressure data relative to a packer pair to identify previously untreated clusters, clusters with cross contamination, and clusters with proper zonal isolation with full pressure integrity.

Background

Hydraulic injection is a method performed by pumping fluid into a formation at a pressure sufficient to create fractures in the formation. When a fracture is open, a propping agent may be added to the fluid. The propping agent, e.g. sand or ceramic beads, remains in the fractures to keep the fractures open when the pumping rate and pressure decreases.

To create sufficient pressure to create fractures, straddle packers are used to isolate an area within the formation. Conventionally, straddle packers are set mechanically or based on a pressure differential between an inner diameter of the tool and an annulus.

Refracturing is an operation to re-stimulate a well after an initial period of production. Refracturing operations attempt to reestablish connectivity with a reservoir and tap new portions of the reservoir. A successful refracturing operation restores well productivity to near original or higher rates of production that extends the productive life of a well. Conventionally, when refracturing which clusters and/or stages have pressure integrity and/or cross communication before restimulating clusters is unknown. This leads to additional risks of the well losing pressure integrity and higher costs associated with restimulating clusters that are communicating with each other.

Accordingly, needs exist for systems and methods for mapping a wellbore before restimulating a well to determine which clusters have proper zonal isolation with full pressure integrity to eliminate the risk of cross communication.

SUMMARY

Examples of the present disclosure relate to systems and methods for mapping a fractured wellbore for refracturing purposes. Embodiments utilize a two-step approach to ensure a cost effective refracturing design to deliver the highest restimulating returns. The two step approach designs a road map for each individual well with a recommendation of acid, chemicals, and fracturing treatments. Systems may include a packer pair including an upstream packer and a downstream packer, first sensors positioned between the packer pair, downstream sensors positioned downstream from the downstream packer, upstream sensors positioned upstream from the upstream packer, and an injection valve.

The pair of packers may be zonal isolation packers that are configured to be hydraulically set and unset based on pressure within an inner diameter of a tool. However, one skilled in the art may appreciate that the packer pair may be set and unset by any known means. In embodiments, the pair of packers may be configured to isolate a zone from an first area above the zone and a second area of the zone on the front end, wherein the front end is positioned between the outer diameter of the tool and the formation. If the geological formation does not have cross communication, the geological formation should isolate the zone on the back end.

Each of the first sensors, downstream sensors, and upstream sensors may include pressure gauges and temperature gauges. The pressure gauges may be configured to determine a pressure at the location of a corresponding gauge, and the temperature gauges may be configured to determine a temperature at the location of a corresponding gauge.

The injection valve may be a device, port, etc. that is configured to allow fluid to flow from the internal diameter of the tool into a formation. In embodiments, the injection valve may be positioned between the downstream packer and the upstream packer, which may be aligned with the isolated zone.

In embodiments, the tool may be run downhole, and the pair of packers set across an annulus extending from an outer diameter of the tool to an inner diameter of casing. When the packers are set across a zone, perforation, cluster, etc. with proper zonal isolation, the gauges may be isolated from each other. When the zone is actually isolated the isolated gauges, the upstream and downstream gauges, should not be impacted by pressure caused by flowing fluid from the injection valve into a targeted cluster between the packer pair.

However, if the packers are set across a zone, perforation, cluster, etc. that has cross communication the first sensor may be in communication with the downstream sensors or the upstream sensors. This may lead to undesirable situations. As such, when fluid is communicated through the injection valve to a zone that is not actually isolated on the backend or front end, the upstream and/or downstream sensors may indicate a pressure change if there is cross communication.

When in use, responsive to setting the packers, fluid may be emitted from the injection valve into the geological formation. When emitting the fluid, the first sensors may determine a first pressure at a first location between the packer pair, the upstream sensors may determine a second pressure at a second location upstream from the upstream packer, and the downstream sensors may determine a third pressure at a third location downstream from the downstream packer. The first, second, and third pressures may be stored within a local memory device within the tool, or transmitted wirelessly. After determining the first, second, and third pressures, the packer pairs may be unset hydraulically moved to a second zone, perforation, cluster, etc. This process may be repeated for each cluster within a well. Because the packer pair is hydraulically set and unset this process may be repeated for an entire wellbore in a single run.

Utilizing the recorded pressure readings throughout the wellbore, a roadmap of which clusters to treat may be created. The roadmap may identify previously untreated clusters, treated clusters, and clusters with cross communication based on pressure differentials between the pressure sensors. This may reduce treatment costs by identifying the clusters that can be treated because of proper zonal isolation.

Furthermore, embodiments may be configured to create a mapping of a wellbore in a single run after a casing has been set and before any refracturing has occurred without positioning any additional tools downhole. As such, the methods and systems described herein may occur based on not only cracks or leaks in the casing on a front end but also on cross communications seen on the backend within the geological formation. Conventional tools may not account for unseen or naturally occurring cracks that occur within clusters due to an original fracturing operations before a refracturing operations occur. Specifically, during an initial fracturing job the chances of cross communication may be minimal, while the likelihood of a damages casing may be higher. Therefore, the chances of leaks on the front end may be higher than on the backend. However, after the fracturing of a well, chances of backend cross communication may increase. Therefore, it is important to be able to deduce locations of cross communications and damages casings after an initial fracturing operation but before a refracturing operation.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
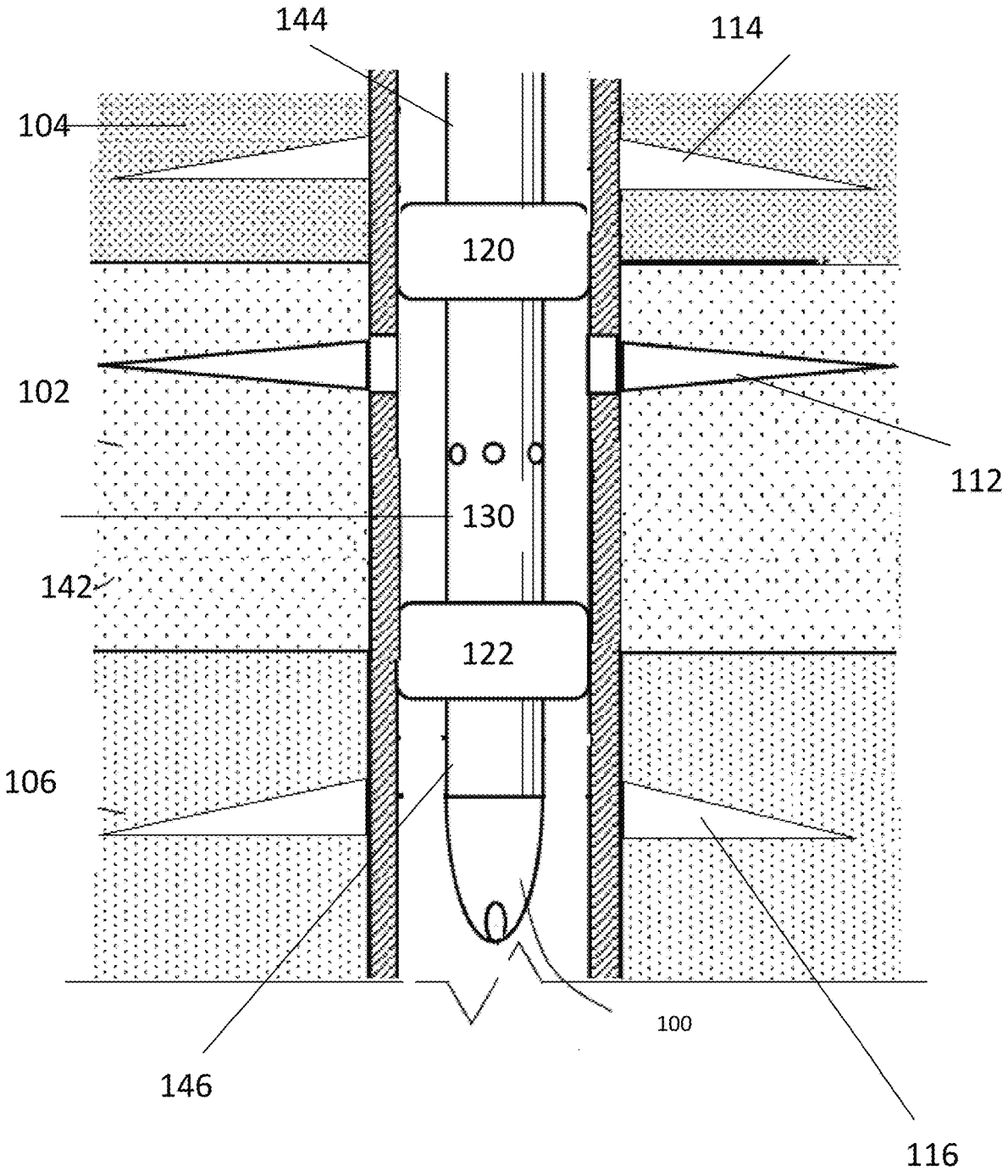
FIG. 1 depicts a tool configured to map out a fractured wellbore of a fractured wellbore, according to an embodiment

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art, that the specific detail need not be employed to practice the present embodiments. In other instances, well-known materials or methods have not been described in detail in order to avoid obscuring the present embodiments.

FIG. 1 depicts a tool 100 configured to map out a fractured wellbore of a fractured wellbore, according to an embodiment. As depicted in FIG. 1, a wellbore may include multiple clusters 112, 114, 116 of fractures. Each of the clusters 112, 114, 116 may be positioned in a different location relative to a packer pair 120, 122. In embodiments, each of the clusters 112, 114, 116 may have a relatively known distance from a wellbore due to an initial fracturing process. For example, each of the clusters 112, 114, 116 may be positioned a predetermined distance from each other. In other implementations, the positioning of clusters 112, 114, 116 may be based on locking and positioning systems. Whereas, in other embodiments, the relative positioning of clusters 112, 114, 116 may be unknown. In embodiments, due to clusters 112, 114, 116 being associated with different locations there should only be minimal cross communication between these clusters within the geological formation.

Tool 100 may include an upstream packer 120, downstream packer 122, injection valve 130, first sensors 142, upstream sensors 144, and downstream sensors 146.

Upstream packer 120 and downstream packer 122 may be a packer pair that is configured to isolate and allow communication across a target zone of the wellbore between the packers responsive to upstream packer 120 and downstream packer 122 being hydraulically set and unset, respectively. This may enable the packer pair to be set and unset without the use of wireline or other tools that could potentially be eroded. In embodiments, the target zone may be a fracture, cluster of fractures, stage, etc. Responsive to isolating a target zone when packer pair 120, 122 are set, data associated with the target zone may be obtained. Then, packer pair 120, 122 may be hydraulically unset, and tool 100 repositioned to isolate a second target zone. Subsequently, packer pair 120, 122 may be hydraulically set, data associated with the second target zone may be obtained, and the packer pair may be hydraulically unset. This procedure may be repeated for numerous clusters and target zones throughout the wellbore in a single trip.

Injection valve 130 may be configured to communicate fluid from an inner diameter of tool 100 into a cluster 112 positioned between upstream packer 120 and downstream packer 122. In embodiments, injection valve 130 may be configured to communicate the fluid responsive to upstream packer 120 and downstream packer 122 being hydraulically set.

First sensors 142, upstream sensors 144, and downstream sensors 146 may each include a pressure gauge and temperature gauge, which may be utilized to determine a pressure and temperature, respectively. First sensors 142 may be positioned between upstream packer 120 and downstream packer 122. Upstream sensors 144 may be positioned upstream from upstream packer 120. Downstream sensors 146 may be positioned downstream from downstream packer 122.

Responsive to setting upstream packer 120 and downstream packer 122, fluid may be emitted from the injection valve 130 into a first isolated cluster 112 within a targeted zone 102. When emitting the fluid, the first sensors 142 may determine a first pressure at a first location between the packer pair 120, 122 associated with the first isolated cluster 112 in the targeted zone 102. Upstream sensors 144 may determine a second pressure at a second zone 104 upstream from upstream packer 120. Downstream sensors 146 may determine a third pressure at a third zone 106 downstream from downstream packer 122. The first, second, and third pressures may be stored within a local memory device within tool 200, or transmitted wirelessly to computing devices at the surface of the wellbore.

After determining the first, second, and third pressures at the targeted zone 102, upstream zone 104, and downstream zone 104, respectively, the packer pair 120, 122 may be unset hydraulically moved to a second-upstream-zone, perforation, cluster, etc. And the process may be repeated for the upstream zone. Because the packer pair 120, 122 is hydraulically set and unset, this process may be repeated for an entire wellbore in a single run without require any other tools to be positioned downhole. Furthermore, the single run may be towards a distal end of the well or towards a surface of the wellbore.

Utilizing the recorded pressure readings throughout the wellbore, a roadmap of which clusters to treat may be created. The roadmap may identify previously untreated clusters and clusters with cross communication based on pressure differentials between the pressure sensors at the targeted zone 102, upstream zone, 104, and downstream zone 106. This may reduce treatment costs by identifying the clusters that can be treated because of proper zonal isolation and clusters that were previously untreated.

In embodiments, if first sensors 142 determine that the pressure associated with a targeted cluster 112 is above a fracturing threshold, such as 5000 psi or a range between 3000 psi to 10,000 psi, while fluid is being emitted from injection valve 130 it may be determined that the targeted cluster 112 was not previously treated and should be refractured. However, if the pressure is below the fracturing threshold, it may be determined that the targeted cluster 112 was previously treated or is cross communicating with another cluster. As such, the targeted cluster 112 may be treated with acid or other chemicals, or skipped entirely. The pressure below the fracturing threshold may indicate that there is cross communication with an adjacent cluster.

In other words, when pressure readings associated with upstream sensor 144 or downstream sensor 146 are not impacted by the communicated fluid from injection valve 130 it may be determined that there is no cross communication, and the targeted cluster 112 has proper zonal isolation. However, if the pressure readings associated with upstream sensor 144 or downstream sensor 146 increase based on the communication of fluid from injection valve 130, then it may be determined there is cross communication with the upstream cluster 114 or downstream cluster 116, correspondingly.

When the first sensors 142 indicate a target cluster 112 is a high pressure zone without cross communication due to the first sensors 112 indicating a pressure rating above the pressure threshold, it may be determined that a cluster was not treated in the initial fracturing operation. As such, a refract treatment with proppant may be utilized to connect new rock with the wellbore. However, if the first sensors 112 indicate a target cluster 112 is a low pressure zone without cross communications due to the first sensors 112 indicating a pressure rating below the pressure threshold, it may be determined that the target cluster 112 was treated in the initial fracturing and needs to proppant treatment.

Additionally, the pressure readings associated with the first sensor 142, upstream sensor 144, and downstream sensor 146 may be utilized in determining if the casing for the wellbore has integrity. If the pressure readings associated with the sensor do not increase past the fracturing threshold, it may be determined that the casing associated with the wellbore does not have integrity, and therefore the wellbore should not be refractured.

Figure 2:
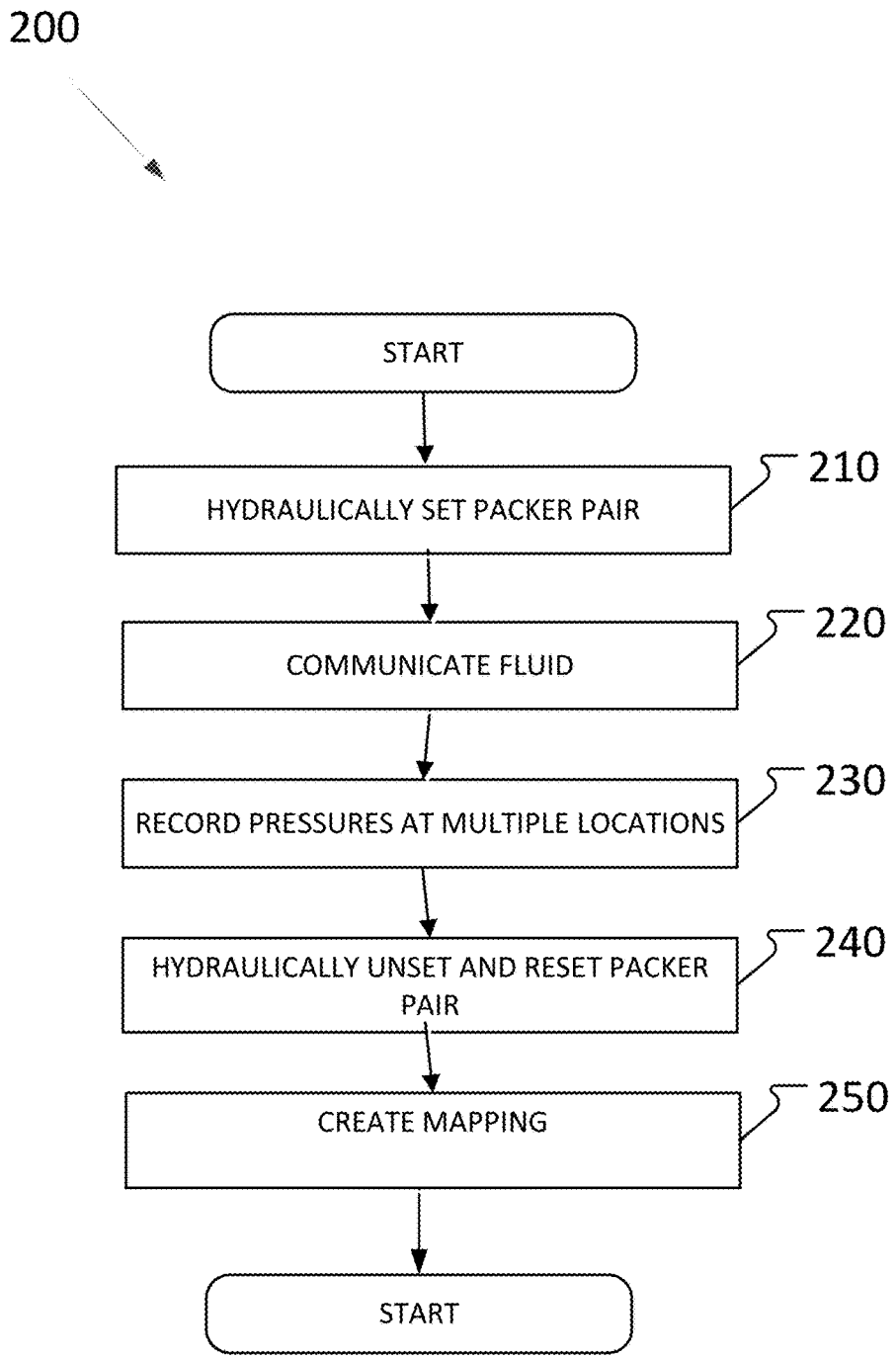
FIG. 2 depicts a method for mapping clusters within a fractured wellbore for refracturing purposes, according to an embodiment.

FIG. 2 depicts a method 200 for mapping clusters within a fractured wellbore for refracturing purposes, according to an embodiment. The operations of method 200 presented below are intended to be illustrative. In some embodiments, method 200 may be accomplished with one or more additional operations not described, and/or without one or more of the operations discussed. Additionally, the order in which the operations of method 200 are illustrated in FIG. 2 and described below is not intended to be limiting. Furthermore, the operations of method 200 may be repeated for subsequent valves or zones in a well.

At operation 210, a packer pair may be hydraulically set at a targeted zone to isolate a targeted cluster, wherein an upstream packer is set upstream from the cluster and a downstream packer is set downstream from a cluster.

At operation 220, fluid may be communicated into the targeted cluster through an injection valve positioned between the set packer pair.

At operation 230, a first pressure sensor positioned between the packer pair may record a first pressure reading at a first location between the packer pair, an upstream pressure sensor may record a second pressure reading at a second location upstream from the packer pair, and a downstream pressure sensor may record a third pressure reading at a location downstream from the packer pair.

At operation 240, the packer pair may be hydraulically unset, and reset at a second target zone with a second cluster, wherein the second target zone may be upstream or downstream of the first target zone. Then operations 210-230 may be repeated for each desired cluster at a wellbore in a single run, wherein the single run may be in a continuous first direction or second direction, or may stagger directions.

At operation 250, a mapping of each of the clusters within the wellbore may be created. Utilizing the mapping, it may be determined which of the clusters to refracture.

Figure 3:
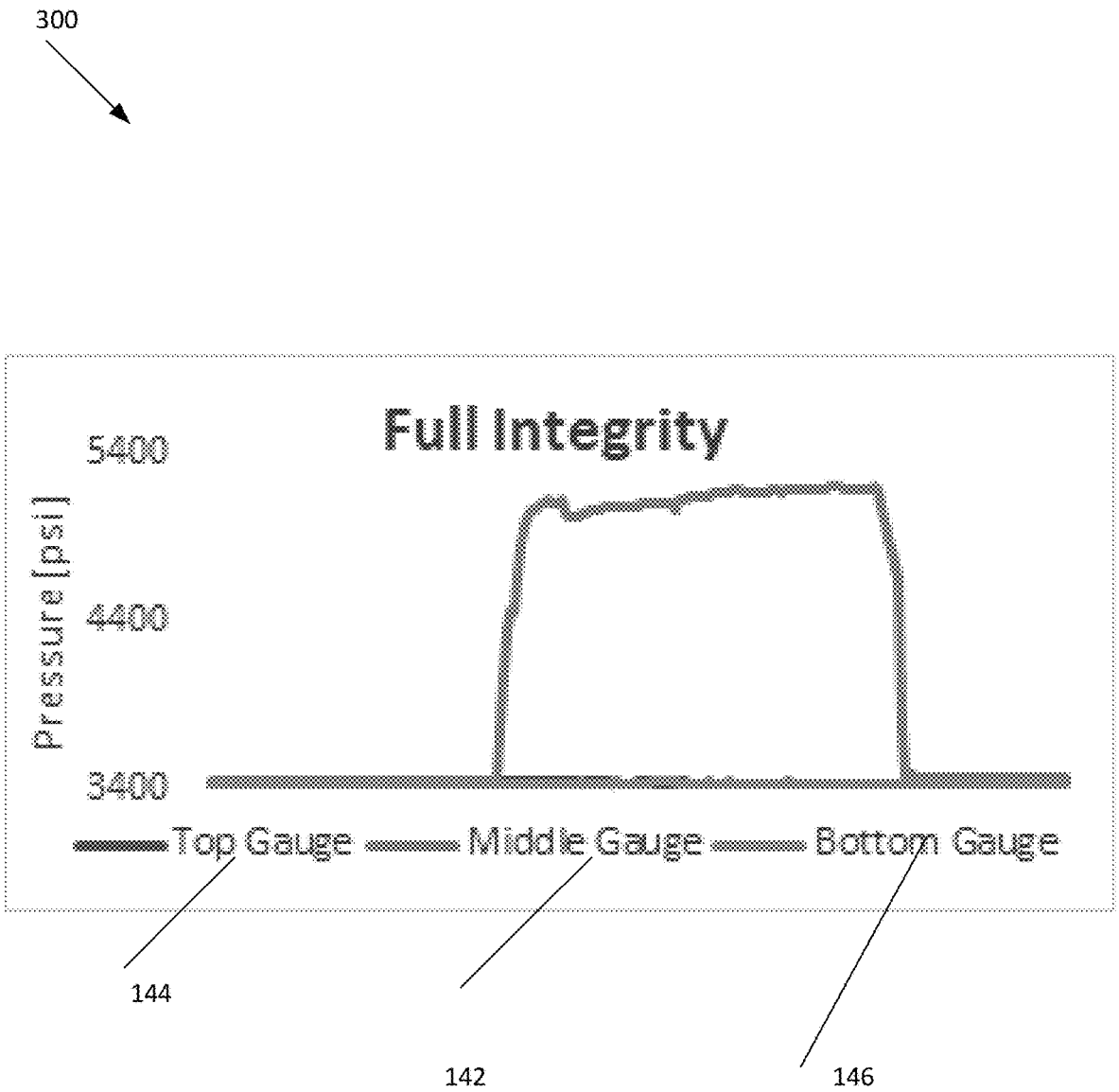
FIG. 3 depicts a graph of a targeted isolated cluster, according to an embodiment

FIG. 3 depicts a graph 300 of a targeted isolated cluster, according to an embodiment. The y-axis of graph 300 may be pressure, and the x-axis of graph 300 may be time. As depicted in FIG. 3, as fluid is communicated to an isolated cluster between a pair of packers over time, first sensors 142 may record a pressure reading of above 5000 psi. Furthermore, as the fluid is communicated to the isolated cluster, there is no impact on the pressure reading above the packer pair or below the packer pair. This may indicate that there is no cross communications with the isolated cluster.

The targeted cluster associated with graph 300 may have full integrity with no communication with clusters above or below the set packers. As such, there is minimal risk of proppant to migrate to clusters above or below the set packers.

Figure 4:
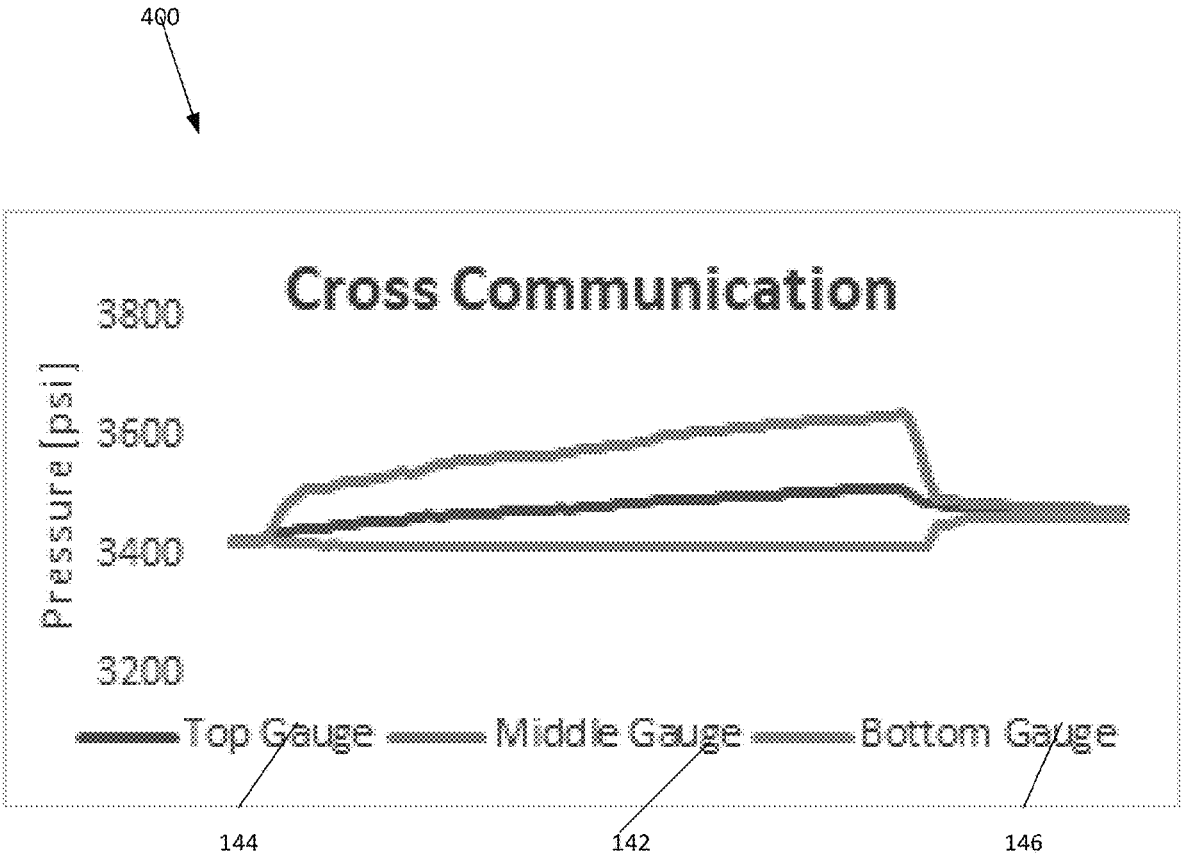
FIG. 4 depicts a graph of a targeted cluster that has cross communication with other clusters, according to an embodiment

FIG. 4 depicts a graph 400 of a targeted cluster that has cross communication with other clusters, according to an embodiment. The y-axis of graph 400 may be pressure, and the x-axis of graph 400 may be time. As depicted in FIG. 4, as fluid is communicated with a cluster between a pair of packers, first sensors 142 may record a first pressure reading. However, as the fluid is being communicating upstream sensors 144 may indicate a rise in pressure that is dependent on the communicated fluid. This may indicate that the targeted cluster is in communication with an upstream cluster.

If there is communication with a cluster above a treating zone/cluster, there is a high risk for getting stuck if proppant is pumped into the targeted cluster. If there is a communication with a cluster below the treating zone/cluster, fluid will travel below the downstream packer into a previously treated cluster. There is a lower risk for getting stuck, but suboptimal for a proppant treatment. If there is communication above and below the treating zone/cluster, there is a high risk for getting stuck.

Figure 5:
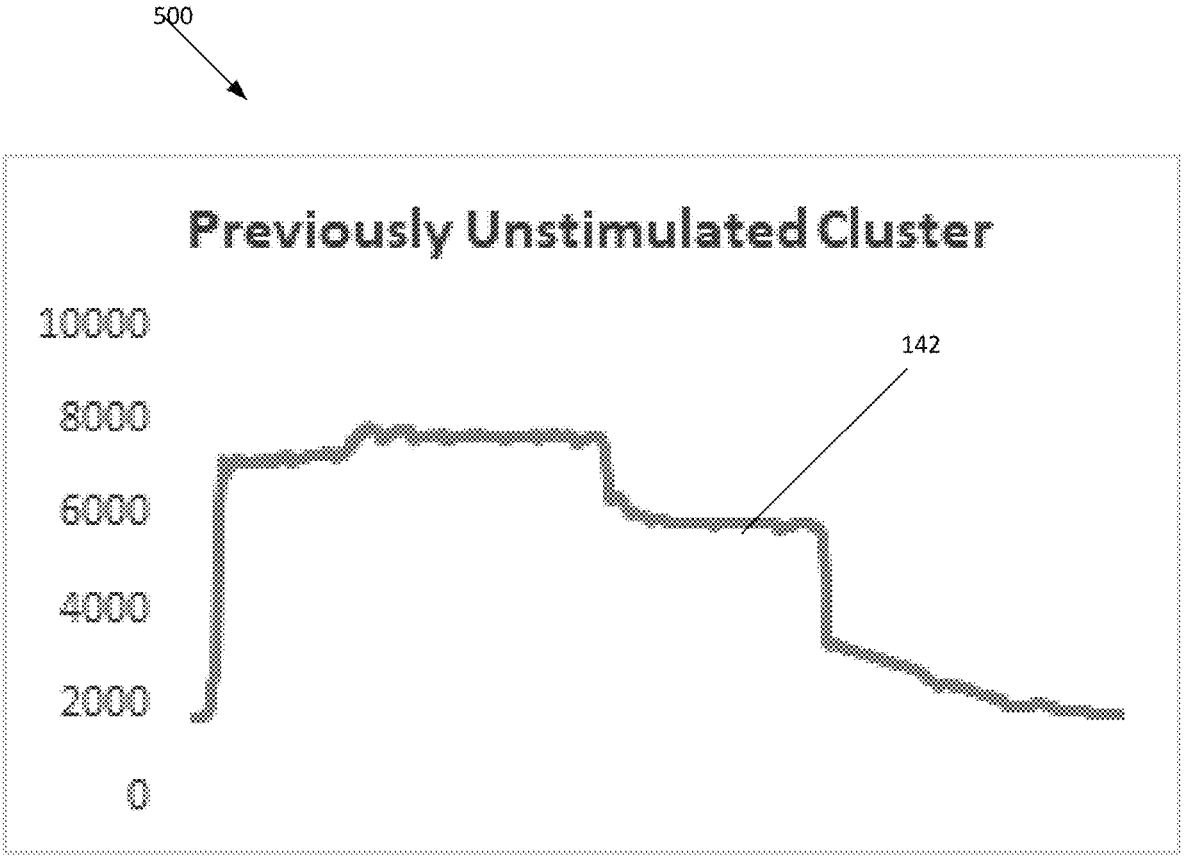
FIGS. 5 and 6 depict graphs that are associated with a previously unstimulated cluster and a previously stimulated cluster, according to an embodiment.
Figure 6:
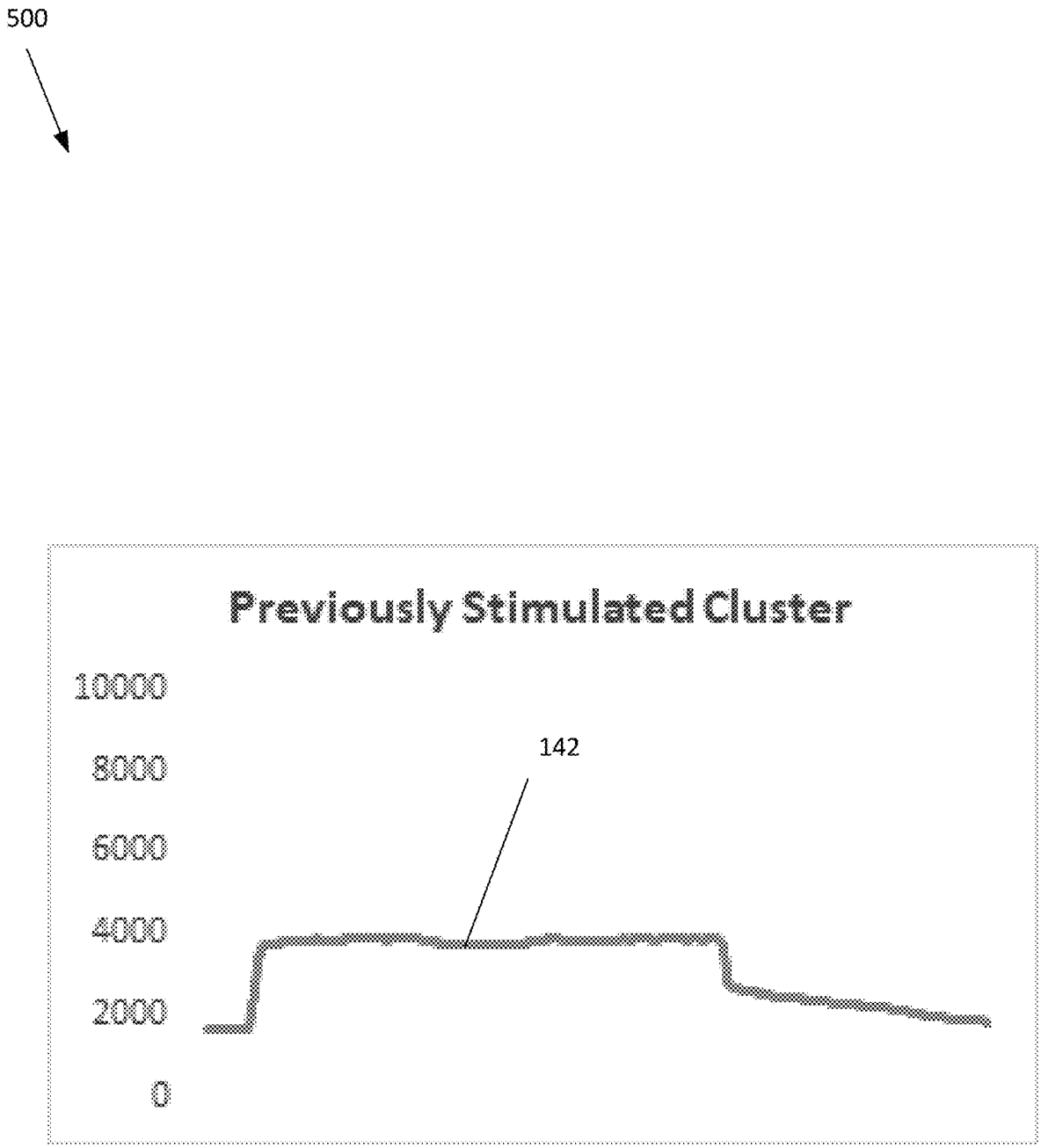

FIGS. 5 and 6 depict graphs 500, 600 that are associated with a previously unstimulated cluster (FIG. 5) and a previously stimulated cluster (FIG. 6). As depicted in FIGS. 5 and 6 for previously unstimulated cluster the pressure reading associated with an isolated cluster may be substantially higher (max psi of around 8000) than a previously stimulated isolated cluster (max PSI of around 4000).

Figure 7:
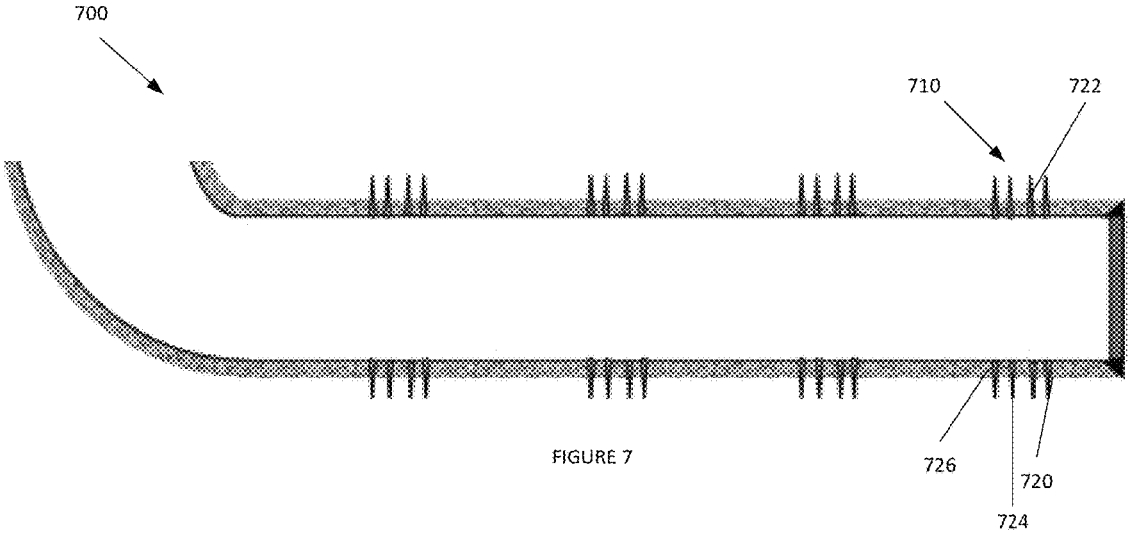
FIG. 7 depicts an embodiment of a well with a stage with a plurality of clusters, according to an embodiment.

FIG. 7 depicts an embodiment of a well 700 with a stage 710 with a plurality of clusters 720, 722, 724, 726.

Figure 8:
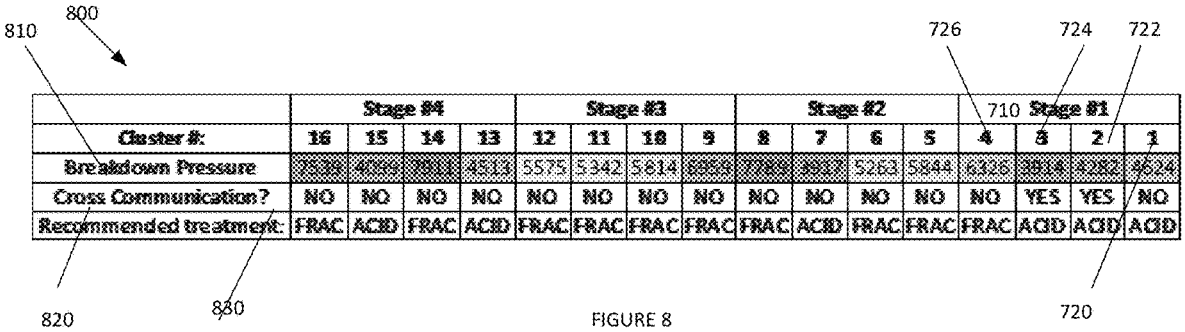
FIG. 8 depicts a mapping of a well after a tool has mapped the well, according to an embodiment.

FIG. 8 depicts a mapping 800 of well 700 after a tool has mapped the well 700. As indicated by mapping 800, a tool 100 may be hydraulically set and unset for each cluster 720, 722, 724, 726 for multiple stages in a well. Fluid may then be substantially communicated to the corresponding targeted cluster. Pressure readings 810 associated with the targeted cluster between the pair of packers may be determined. If the pressure reading 810 associated with a given cluster is above a fracturing threshold, such as 5000 psi, it may be determined that the targeted cluster was not previously fractured. Further, while the fluid is being communicated to the targeted cluster, cross communications 820 pressure readings may be determined by comparing the pressure reading associated with a sensor between the packer pair and upstream sensors, and the pressure reading associated with the sensor between the packer pair and downstream sensors. If the upstream and/or downstream sensors indicate a pressure that is dependent on the pressure between the packer pair, it may be determined that there is cross communication between the clusters. Additionally, if there is no cross communication and the pressure associated with the targeted cluster is above the fracturing threshold, a recommendation 830 to fracturing the isolated cluster may be indicated. If not, a recommendation 830 to communicated acid to the targeted cluster may be indicated.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale. For example, in embodiments, the length of the dart may be longer than the length of the tool.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A method for mapping a wellbore before a refracting procedure, the method comprising:

running a tool downhole after a fracturing procedure, the tool including a packer pair, a first pressure sensor positioned between the packer pair, a second pressure sensor positioned upstream of the packer pair, and a third pressure sensor positioned downstream of the packer pair;

hydraulically setting the packer pair at a first location;

communicate fluid through an injection valve positioned between packers of the packer pair;

recording a first pressure via the first pressure sensor while communicating the fluid through the injection valve;

recording a second pressure via the second pressure sensor while communicating the fluid through the injection valve;

recording a third pressure via the third pressure sensor while communicating the fluid through the injection valve;

determining if the first pressure recorded by the first pressure sensor is above a pressure threshold;

comparing the first pressure to the second pressure and the third pressure;

determining the first location was not treated in an initial fracturing operation when the third pressure is not correlated with the first pressure and that the first pressure is above the pressure threshold;

hydraulically setting the packer pair at a second location; wherein the tool is moved from the first location to the second location without positioning any other tools downhole;

communicating fluid through the injection valve positioned between packers of the packer pair at the second location;

recording a fourth pressure via the first pressure sensor while communicating the fluid through the injection valve at the second location;

recording a fifth pressure via the second pressure sensor while communicating the fluid through the injection valve at the second location;

recording a sixth pressure via the third pressure sensor while communicating the fluid through the injection valve at the second location;

comparing the fourth pressure to the fifth pressure and the sixth pressure; determining that the fourth pressure is below the pressure threshold;

recording a mapping of the wellbore including the first pressure and the fourth pressure in a single run by hydraulically setting and unsetting the packer pair at the first location and second location within the wellbore before the refracturing procedure at the first location, wherein the mapping indicates to perform the refracture procedure at the first location and to not refracture the second location.

2. The method of claim 1, further comprising:

determining that the fourth pressure is correlated to the fifth pressure.

3. The method of claim 1, further comprising:

determining that the fourth pressure is correlated to the sixth pressure.

4. The method of claim 1, further comprising:

determining that the fourth pressure is not correlated to the fifth pressure or to the sixth pressure, and determining that the fourth pressure is below the pressure threshold.

5. The method of claim 1, wherein the pressure threshold is at least 3000 psi, wherein the pressure threshold indicates to perform the refracturing procedure when a recorded pressure is above the pressure threshold, and wherein the pressure threshold indicates to not perform the refracturing procedure when the recorded pressure is below the pressure threshold due to cross-communication.

6. The method of claim 1, wherein the first location is associated with a first cluster within the wellbore.

* * * * *